US012460149B2

(12) United States Patent
Uekusa et al.

(10) Patent No.: US 12,460,149 B2
(45) Date of Patent: Nov. 4, 2025

(54) LUBRICATING OIL COMPOSITION

(71) Applicant: MITSUI CHEMICALS, INC., Tokyo (JP)

(72) Inventors: Takayuki Uekusa, Ichihara (JP); Kiyohide Inomata, Ichihara (JP); Akihiro Udagawa, Chiba (JP); Shuhei Yamamoto, Ichihara (JP)

(73) Assignee: Mitsui Chemicals, Inc., Tokyo (JP)

( * ) Notice: Subject to any disclaimer, the term of this patent is extended or adjusted under 35 U.S.C. 154(b) by 0 days.

(21) Appl. No.: 18/694,039

(22) PCT Filed: Sep. 28, 2022

(86) PCT No.: PCT/JP2022/036093

§ 371 (c)(1),
(2) Date: Mar. 21, 2024

(87) PCT Pub. No.: WO2023/054440

PCT Pub. Date: Apr. 6, 2023

(65) Prior Publication Data

US 2024/0384197 A1 Nov. 21, 2024

(30) Foreign Application Priority Data

Sep. 30, 2021 (JP) ..... 2021-161607

(51) Int. Cl.

| | |
|---|---|
| ***C10M 143/08*** | (2006.01) |
| ***C10M 101/02*** | (2006.01) |
| ***C10M 169/04*** | (2006.01) |
| *C10N 20/02* | (2006.01) |
| *C10N 30/02* | (2006.01) |

(52) U.S. Cl.
CPC ..... *C10M 143/08* (2013.01); *C10M 101/02* (2013.01); *C10M 169/041* (2013.01); *C10M 2203/1006* (2013.01); *C10M 2205/028* (2013.01); *C10N 2020/02* (2013.01); *C10N 2030/02* (2013.01)

(58) Field of Classification Search
CPC ..... C10M 143/08; C10M 101/02; C10M 169/041; C10M 2205/028; C10N 2030/08
USPC ..... 508/591
See application file for complete search history.

(56) References Cited

U.S. PATENT DOCUMENTS

| | | | | |
|---|---|---|---|---|
| 3,265,622 | A * | 8/1966 | Anderson | C08F 210/00 585/12 |
| 4,877,557 | A * | 10/1989 | Kaneshige | C10M 137/04 508/306 |
| 9,045,574 | B2 | 6/2015 | Ikeda et al. | |
| 11,162,050 | B2 | 11/2021 | Hayakawa et al. | |
| 11,873,462 | B2 | 1/2024 | Hayakawa et al. | |
| 2007/0249792 | A1* | 10/2007 | Kawahara | C08F 210/14 526/170 |
| 2012/0190601 | A1* | 7/2012 | Ikeda | C10M 143/08 508/459 |
| 2012/0220728 | A1* | 8/2012 | Uekusa | C08L 23/20 525/240 |
| 2018/0320102 | A1* | 11/2018 | Hayakawa | C08F 255/04 |
| 2019/0338212 | A1* | 11/2019 | Abe | C10M 169/041 |
| 2020/0140776 | A1* | 5/2020 | Hayakawa | C10M 169/041 |
| 2021/0130725 | A1 | 5/2021 | Hayakawa et al. | |
| 2022/0275304 | A1* | 9/2022 | Hayakawa | C10M 101/00 |

FOREIGN PATENT DOCUMENTS

| | | | |
|---|---|---|---|
| JP | 2013-506036 | A | 2/2013 |
| WO | WO-2018/124070 | A1 | 7/2018 |
| WO | WO-2021/039818 | A1 | 3/2021 |

* cited by examiner

*Primary Examiner* — Ellen M Mcavoy
(74) *Attorney, Agent, or Firm* — Foley & Lardner LLP

(57) ABSTRACT

An object of the present invention is to provide a lubricating oil composition that is particularly excellent in viscosity characteristics at a low temperature of −35° C., i.e., the lubricating oil composition inhibiting an increase in low temperature viscosity while securing a viscosity necessary at an elevated temperature, and being excellent in storage stability in a low temperature environment. The present invention relates to a lubricating oil composition including a copolymer (A) and a base oil (B), in which the copolymer (A) satisfies the following requirement (a-1), and the content ratio between the copolymer (A) and the base oil (B) is such that the copolymer (A) is in a range of 0.1 to 50 parts by mass per 100 parts by mass in total of the copolymer (A) and the base oil (B).

(a-1) The copolymer (A) is a copolymer of 4-methyl-1-pentene and an α-olefin having 20 or less carbon atoms excluding 4-methyl-1-pentene, including a constituent unit derived from 4-methyl-1-pentene within a range of 1 mol % or more and less than 30 mol % relative to the total constituent units.

6 Claims, No Drawings

LUBRICATING OIL COMPOSITION

TECHNICAL FIELD

The present invention relates to a lubricating oil composition that includes a specific copolymer and is excellent in viscosity characteristics at low temperatures.

BACKGROUND ART

The reduction of petroleum resources and environmental issues such as global warming have led to a demand for enhancement of fuel consumption of lubricating machines in order to reduce emissions of exhaust gas pollutants and $CO_2$. Fuel saving with a lubricating oil is excellent in cost effectiveness compared with the physical improvement of a lubricating machine and therefore expected as an important fuel saving technique, and the demand is increasing for fuel consumption enhancement with a lubricating oil. Power loss in a lubricating machine can be divided into friction loss at a sliding part and agitation loss due to a viscosity of lubricating oil, and examples of countermeasures for fuel saving include reduction of viscosity of the lubricating oil. In particular, a low temperature viscosity remains in great demand because it contributes to fuel consumption enhancement under low temperature conditions, such as when starting an engine.

As one of methods for improving low-temperature storage stability and low temperature characteristics of a lubricating oil composition, a lubricating oil composition containing a copolymer having a constituent unit derived from 4-methyl-1-pentene in a range of 30 to 90 mol % and a base oil has been proposed (Patent Literature 1).

CITATION LIST

Patent Literature

[Patent Literature 1] WO2018/124070

SUMMARY OF INVENTION

Technical Problem

Conventional lubricating oil compositions are still insufficient in terms of balance between storage stability at low temperatures and low temperature characteristics.

An object of the present invention is to provide a lubricating oil composition that is particularly excellent in viscosity characteristics at a low temperature of −35° C., i.e., the lubricating oil composition inhibiting an increase in low temperature viscosity while securing a viscosity necessary at an elevated temperature, and being excellent in storage stability in a low temperature environment.

Solution to Problem

The present invention relates to a lubricating oil composition including a copolymer (A) and a base oil (B), wherein the copolymer (A) satisfies the following requirement (a-1), and a content ratio between the copolymer (A) and the base oil (B) is such that the copolymer (A) is in a range of 0.1 to 50 parts by mass per 100 parts by mass in total of the copolymer (A) and the base oil (B).

(a-1) The copolymer (A) is a copolymer of 4-methyl-1-pentene and an α-olefin having 20 or less carbon atoms excluding 4-methyl-1-pentene, including a constituent unit derived from 4-methyl-1-pentene within a range of 1 mol % or more and less than 30 mol % relative to the total constituent units.

Advantageous Effect of Invention

The lubricating oil composition of the present invention improves low temperature viscosity characteristic (CCS) at −35° C. (the viscosity decreases) while maintaining a viscosity index (VI), thereby providing less loss upon startup and a high fuel consumption saving effect. The lubricating oil composition of the present invention forms no gel or sediment due to favorable solubility in base oil, leading to excellent storage stability in a low temperature environment.

DESCRIPTION OF EMBODIMENTS

The present invention will be specifically described below. In the following description, "to" indicating a numerical range represents "or more and or less" unless otherwise specified.

<Lubricating Oil Composition>

The lubricating oil composition of the present invention contains a copolymer (A) and a base oil (B). The constituents will be described in detail below.

<<Copolymer (A)>>

A copolymer (A) that is one of the components of the lubricating oil composition of the present invention, is a copolymer satisfying the following requirement (a-1).

<Requirement (a-1)>

The copolymer (A) is a copolymer of 4-methyl-1-pentene and an α-olefin having 20 or less carbon atoms excluding 4-methyl-1-pentene, including a constituent unit derived from 4-methyl-1-pentene within a range of 1 mol % or more and less than 30 mol %, preferably in a range of 5 to 29 mol %, relative to the total constituent units.

A constituent unit derived from 4-methyl-1-pentene being less than the upper limit value reduces polymer molecular volume in solution, thereby reducing low temperature viscosity characteristics, which is preferred.

Examples of the α-olefin having 20 or less carbon atoms include linear α-olefins having 2 to 20 carbon atoms, such as ethylene, propylene, 1-butene, 1-pentene, 1-hexene, 4-methyl-1-pentene, 1-octene, 1-decene, 1-undecene, 1-dodecene, 1-tetradecene, 1-hexadecene, 1-octadecene, and 1-eicosene, preferably 2 to 15 carbon atoms, and more preferably 2 to 10 carbon atoms, and branched α-olefins having 5 to 20 carbon atoms and preferably 5 to 15 carbon atoms, such as 3-methyl-1-butene, 3-methyl-1-pentene, 3-ethyl-1-pentene, 4,4-dimethyl-1-pentene, 4-methyl-1-hexene, 4,4-dimethyl-1-hexene, 4-ethyl-1-hexene, and 3-ethyl-1-hexene.

α-Olefin to be copolymerized with 4-methyl-1-pentene is preferably ethylene, propylene, 1-butene, 1-pentene, 1-hexene and 1-octene, more preferably ethylene or propylene, and particularly preferably propylene.

The copolymer (A) according to the present invention preferably satisfies the following requirement (a-2) in addition to the requirement (a-1) above, and at least one of (a-3) and (a-4).

<Requirement (a-2)>

The intrinsic viscosity [η] measured in decalin at 135° C. is in a range of 0.01 to 5.0 dl/g, preferably in the range of 0.05 to 4.0 dl/g, more preferably in the range of 0.45 to 2.3 dl/g, further preferably in the range of 0.1 to 2.5 dl/g, and particularly preferably in the range of 1.3 to 2.0 dl/g.

The intrinsic viscosity [η] can fall within the above range by controlling a polymerization temperature upon polymerization of the copolymer (A) and a molecular weight regulator such as hydrogen, for example. The higher the intrinsic viscosity [η], the higher the viscosity of the copolymer (A) and the resulting lubricating oil composition. When a lubricating oil composition is obtained, the amount of viscosity modifier for lubricating oil added is appropriately adjusted in order to adjust physical properties necessary for the lubricating oil composition, such as a specific 100° C. kinematic viscosity, and the fact that the intrinsic viscosity [η] of the copolymer (A) be in the above range is preferred in terms of being able to be in suitable ratio with respect to the base oil.

<Requirement (a-3)>

A melting point (Tm) is not detected within a range of −10 to 40° C. in differential scanning calorimetry (DSC). In other words, the copolymer (A) is amorphous or low crystalline, and therefore has excellent storage stability at low temperatures.

<Requirement (a-4)>

A glass transition temperature (Tg) is in a range of −30 to 20° C. and preferably in a range of −20 to 15° C. in differential scanning calorimetry (DSC). Within the above range of the glass transition temperature (Tg), the copolymer (A) is vitrified in a low temperature region at the glass transition temperature (Tg) or lower, and an increase in cohesive force of the molecules can be expected to reduce the volume occupied by the polymer molecules in the lubricating oil composition.

Adjusting the glass transition temperature (Tg) of the copolymer (A) within the above range, which is an intermediate range between low temperature and elevated temperature, is considered to enable an increase in molecular cohesive force at low temperatures despite the copolymer (A) having no crystallinity, resulting in having enabled a low temperature viscosity of the resulting lubricating oil composition to be reduced. In other words, having a higher glass transition temperature than conventionally used amorphous polymers while maintaining excellent storage stability of the resulting lubricating oil composition at a low temperature environment, which is obtained from the copolymer (A) being amorphous or low crystalline, is considered to ensure excellent flowability at low temperatures.

<Method for Producing Copolymer (A)>

A method for producing the copolymer (A) according to the present invention is not particularly limited, as long as those satisfying the prescribed requirements described above can be obtained, and the copolymer (A) can be obtained by polymerizing 4-methyl-1-pentene and an α-olefin in the presence of an appropriate polymerization catalyst.

As a suitable polymerization catalyst for obtaining the copolymer (A) according to the present invention, a conventionally known catalyst, such as a magnesium-supported titanium catalyst and the method described in the metallocene catalysts described in WO01/53369, WO01/27124, JPH3-193796A, JPH02-41303A, or WO14/050817, can be employed.

<<Base Oil (B)>>

The base oil (B) that is one of the components of the lubricating oil composition of the present invention, preferably satisfies the following requirement (b-1).

<Requirement (b-1)>

The kinematic viscosity at 100° C. is in the range of 1 to 50 $mm^2/s$.

Examples of the base oil (B) according to the present invention include mineral oils; and synthetic oils such as poly-α-olefins, diesters, and polyalkylene glycols.

As the base oil (B) according to the present invention, a mineral oil or a blend of a mineral oil and a synthetic oil may be used. Examples of the diesters include polyol esters, dioctyl phthalate, and dioctyl sebacate.

Mineral oils are generally used after being subjected to a refining step such as wax removal, and have several grades by the refining process. Generally, mineral oils including 0.5 to 10% of wax components are used. For example, highly refined oils having a low pour point and a high viscosity index and having a composition mainly including isoparaffin that are produced by a hydrocracking refining method can also be used. Mineral oils having a kinematic viscosity of 10 to 200 $mm^2/s$ at 40° C. are generally used.

As described above, mineral oils are generally used after being subjected to a refining step such as wax removal and have several grades by the refining process, and the grades are provided in the API (American Petroleum Institute) classification. The characteristics of lubricating oil bases classified into groups are shown in Table 1.

TABLE 1

| Group | Oil kind | Viscosity index *1 | Saturated hydrocarbon content (% by volume) *2 | Sulfur content (% by weight) *3 |
|---|---|---|---|---|
| (i) | Mineral oil | 80-120 | <90 | >0.03 |
| (ii) | Mineral oil | 80-120 | ≥90 | ≤0.03 |
| (iii) | Mineral oil | ≥120 | ≥90 | ≤0.03 |
| (iv) | Poly-α-olefin | | | |
| (v) | Lubricating oil base other than the above described | | | |

*1: Measurement in accordance with ASTM D445 (JIS K2283)
*2: Measurement in accordance with ASTM D3238
*3: Measurement in accordance with ASTM D4294 (JIS K2541)

The poly-α-olefins in Table 1 are hydrocarbon-based polymers obtained by polymerizing at least an α-olefin having 10 or more carbon atoms as one raw material monomer, and, for example, polydecene obtained by polymerizing 1-decene is illustrated.

As the base oil (B), a mineral oil belonging to the group (II) or the group (III) or a poly-α-olefin belonging to the group (IV) is preferred, and the mineral oil belonging to the group (III) is more preferred. The group (II) and the group (III) tend to have a lower wax concentration than the group (I).

Among mineral oils belonging to the group (II) or the group (III), those with a kinematic viscosity of 1 to 50 $mm^2/s$ at 100° C. are preferred.

<<Content Ratio between Copolymer (A) and Base Oil (B)>>

In the lubricating oil composition of the present invention, the content ratio between the copolymer (A) and the base oil (B) is such that the copolymer (A) is in a range of 0.1 to 50 parts by mass per 100 parts by mass in total of the copolymer (A) and the base oil (B).

In the case of using the lubricating oil composition of the present invention for engine applications and the like, it preferably contains 0.1 to 5 parts by mass of the copolymer (A) and 95 to 99.9 parts by mass of the base oil (B) (provided that the sum of the copolymer (A) and the base oil (B) is 100 parts by mass). The copolymer (A) is preferably contained at a proportion of 0.2 to 4 parts by mass, more preferably 0.4 to 3 parts by mass, still more preferably 0.6 to 2 parts by mass, and the base oil (B) is preferably contained at a proportion of 96 to 99.8 parts by mass, more preferably 97 to 99.6 parts by mass, and still more preferably 98 to 99.4 parts by mass. The copolymer (A) may be used singly or in combinations of plural kinds thereof.

In the case of using the lubricating oil composition of the present invention as a lubricating oil additive composition (so-called concentrate), on the other hand, the lubricating oil composition preferably contains the copolymer (A) at a proportion of 1 to 50 parts by mass and the base oil (B) at a proportion of 50 to 99 parts by mass (provided that the sum of the copolymer (A) and base oil (B) is 100 parts by mass). The lubricating oil composition of the present invention more preferably contains the copolymer (A) in the range of 2 to 40 parts by mass and the base oil (B) in the range of 60 to 98 parts by mass, and more preferably contains the copolymer (A) in the range of 3 to 30 parts by mass and the base oil (B) in the range of 70 to 97 parts by mass.

When the lubricating oil composition of the present invention is used as a lubricating oil additive composition (so-called concentrate), usually, the lubricating oil composition generally includes no pour-point depressant (C) and other components (additives) described later or contains an antioxidant described later in the range of 0.01 to 1% by mass, preferably 0.05 to 0.5% by mass, as needed. The lubricating oil additive composition can be used for various applications as a lubricating oil composition by blending the base oil (B) and the pour-point depressant (C) and other components (additives) described later.

<Pour-Point Depressant (C)>

The lubricating oil composition of the present invention may further contain the pour-point depressant (C). The content of the pour-point depressant (C) is not particularly limited as long as the effect of the present invention is achieved. The pour-point depressant (C) is usually contained in an amount of 0.05 to 5% by mass, preferably 0.05 to 3% by mass, more preferably 0.05 to 2% by mass, and further preferably 0.05 to 1% by mass based on 100% by mass of the lubricating oil composition.

Examples of the pour-point depressant (C) that the lubricating oil composition of the present invention may contain include, for example, alkylated naphthalenes, (co) polymers of alkyl methacrylates, (co) polymers of alkyl acrylates, copolymers of alkyl fumarates and vinyl acetate, α-olefin polymers, and copolymers of α-olefins and styrene. Particularly, (co) polymers of alkyl methacrylates and (co) polymers of alkyl acrylates may be used.

<Other Components (Additive)>

The lubricating oil composition of the present invention may also contain other components (additive) other than the above copolymer (A) and base oil (B). Examples of other components optionally include any one or more materials described later.

When the lubricating oil composition of the present invention contains an additive, the content of the additive is, though not particularly limited, usually more than 0% by mass, preferably 1% by mass or more, more preferably 3% by mass or more, and further preferably 5% by mass or more, per 100% by mass in total of the base oil (B) and the additive. The content of the additive is usually 40% by mass or less, preferably 30% by mass or less, more preferably 20% by mass or less, and further preferably 15% by mass or less.

One such additive is a detergent. Many conventional detergents used in the field of engine lubrication provide basicity or TBN to lubricating oils by the presence of basic metal compounds (typically metal hydroxides, metal oxides, and metal carbonates based on metals such as calcium, magnesium, and sodium). Such metallic overbased detergents (also referred to as overbased salts or ultrabasic salts) are usually single phase homogeneous Newtonian systems characterized by a metal content exceeding an amount that seems to be present for neutralization according to the stoichiometry of a metal and a particular acidic organic compound that reacts with the metal. An overbased material is typically prepared by reacting an acidic material (typically an inorganic acid such as carbon dioxide or a lower carboxylic acid) with a mixture of an acidic organic compound (also referred to as substrate) and a metal salt in a stoichiometrically excess amount, typically in an organic solvent (for example, a mineral oil, naphtha, toluene, or xylene) inert to the acidic organic substrate. A small amount of an accelerating agent such as a phenol or an alcohol is optionally present. The acidic organic substrate will usually have a sufficient number of carbon atoms in order to provide a certain degree of solubility in oils.

Such conventional overbased materials and methods for preparing these are well-known to those skilled in the art. Examples of patents describing techniques for making basic metal salts of sulfonic acids, carboxylic acids, phenols, phosphoric acids, and mixtures of two or more thereof include U.S. Pat. Nos. 2,501,731; 2,616,905; 2,616,911; 2,616,925; 2,777,874; 3,256, 186; 3, 384, 585; 3, 365, 396; 3, 320, 162; 3,318,809; 3,488,284; and 3,629,109. Salixarate detergents are described in U.S. Pat. No. 6,200,936 and International Publication No. WO01/56968. A saligenin detergent is described in U.S. Pat. No. 6,310,009.

The amount of a typical detergent in the lubricating oil composition is not particularly limited as long as the effect of the present invention is achieved. The amount of the typical detergent is usually 1 to 10% by mass, preferably 1.5 to 9.0% by mass, and more preferably 2.0 to 8.0% by mass. The amounts are all based on an oil-free state (that is, a state free from a diluent oil conventionally supplied to them).

Another additive is a dispersant. Dispersants are well-known in the field of lubricating oils, and examples of the dispersants mainly include those known as ashless dispersants and polymer dispersants. The ashless dispersants are characterized by a polar group attached to a hydrocarbon chain having a relatively large molecular weight. Examples of the typical ashless dispersant include a nitrogen-containing dispersant such as a N-substituted long chain alkenylsuccinimide, which is also known as a succinimide dispersant. Succinimide dispersants are more sufficiently described in U.S. Pat. Nos. 4,234,435 and 3,172,892. Another class of ashless dispersants is high molecular weight esters prepared by reaction of a polyvalent aliphatic alcohol such as glycerol, pentaerythritol or sorbitol, and a hydrocarbyl acylating agent. Such materials are described in more detail in U.S. Pat. No. 3,381,022. Another class of the ashless dispersants is the Mannich bases. These are materials formed by the condensation of a high molecular weight alkyl-substituted phenol, an alkylenepolyamine, and an aldehyde such as formaldehyde and are described in more detail in U.S. Pat. No. 3,634,515. Examples of other dispersants include polyvalent dispersible additives, which are generally polymers based on hydrocarbons having polar functionality that provides dispersion characteristics to the above polymer.

The dispersant may be subjected to post-treatment by reacting it with any of various substances. Examples of these include urea, thiourea, dimercaptothiadiazole, carbon disulfide, aldehydes, ketones, carboxylic acids, hydrocarbon-substituted succinic anhydrides, nitriles, epoxides, boron compounds, and phosphorus compounds. References describing such treatment in detail are listed in U.S. Pat. No. 4,654,403. The amount of the dispersant in the composition of the present invention is not particularly limited as long as the effect of the present invention is achieved. The amount of the dispersant can be typically 1 to 10% by mass, preferably 1.5 to 9.0% by mass, and more preferably 2.0 to 8.0% by mass (all are based on an oil-free state).

Another component is an antioxidant. Antioxidants encompass phenolic antioxidants, and these may include butyl-substituted phenols having two to three t-butyl groups. The para position may be occupied by a hydrocarbyl group or a group bonding two aromatic rings. The latter antioxidant is described in more detail in U.S. Pat. No. 6,559,105. The antioxidants also include aromatic amines such as nonylated diphenylamine. Examples of other antioxidants include sulfurized olefins, titanium compounds, and molybdenum compounds. For example, U.S. Pat. No. 4,285,822 discloses a lubricating oil composition including a composition including molybdenum and sulfur. A typical amount of the antioxidant will of course depend on the specific antioxidant and its individual effectiveness, but an exemplary total amount can be 0.01 to 5% by mass, preferably 0.15 to 4.5% by mass, and more preferably 0.2 to 4% by mass. Further, one or more antioxidants may be present, and with a particular combination of these, the combined overall effect of these can be synergistic.

A thickener (also sometimes referred to as a viscosity index improver or a viscosity modifier) may be included in the lubricating oil additive composition. The thickener is usually a polymer, and examples thereof include, for example, polyisobutenes, polymethacrylates, diene polymers, polyalkylstyrenes, esterified styrene-maleic anhydride copolymers, alkenylarene conjugated diene copolymers, and polyolefins, hydrogenated SBR (styrene butadiene rubber), and SEBS (styrene ethylene butylene styrene block copolymer). A multifunctional thickener also having dispersion properties and/or antioxidant properties is known and may be optionally used.

Another additive is an anti-wear agent. Examples of the anti-wear agent include phosphorus-containing anti-wear agents/extreme pressure agents such as metal thiophosphates, phosphate esters and salts thereof, and phosphorus-containing carboxylic acids, esters, ethers, and amides; and phosphites. In a particular aspect, a phosphorus anti-wear agent may usually be present in an amount that provides 0.01 to 0.2% by mass, preferably 0.015 to 0.15% by mass, more preferably 0.02 to 0.1% by mass, and further preferably 0.025 to 0.08% by mass of phosphorus, which is not particularly limited as long as the effect of the present invention is achieved.

In many cases, the above anti-wear agent is a zinc dialkyldithiophosphate (ZDP). A typical ZDP may include 11% by mass of P (calculated based on an oil-free state), and examples of a preferred amount may include 0.09 to 0.82% by mass. Examples of anti-wear agents including no phosphorus include borate esters (including boric acid epoxides), dithiocarbamate compounds, molybdenum-containing compounds, and sulfurized olefins.

Examples of other additives that may be optionally used in the lubricating oil composition include, in addition to the extreme pressure agent and anti-wear agent, a friction modifier, a color stabilizer, a rust preventive, a metal deactivator, and an antifoaming agent, and each may be used in a conventionally known amount.

<Method for Producing Lubricating Oil Composition>

The lubricating oil composition of the present invention can be prepared by mixing the copolymer (A) and the base oil (B), optionally together with other desired components, in a conventionally known manner. The copolymer (A) is easy in handling, whereby it may be arbitrarily supplied as a concentrate in the base oil (B).

The lubricating oil composition of the present invention has excellent low temperature storage stability and a low temperature viscosity. Thus, the lubricant oil compositions of the invention can be lubricated in any of a variety of known pieces of mechanical apparatus, for example, as a lubricating oil for gasoline engines, a lubricating oil for diesel engines, a lubricating oil for marine engines, a lubricating oil for two-stroke engines, a lubricating oil for automatic transmissions and manual transmissions, a gear lubricating oil, and grease.

EXAMPLES

The present invention will be more specifically described below based on Examples, but the present invention is not limited to these Examples.

The copolymers used in Examples and Comparative Examples were produced by the following production methods.

Production Example 1

Into a fully nitrogen-substituted SUS autoclave with stirring blades having a capacity of 1.5 liters, 650 ml of 4-methyl-1-pentene was charged at 23° C. and 100 ml of hexane was charged. To this autoclave was charged 0.75 ml of a 1.0 mmol/ml toluene solution of triisobutylaluminum (TIBAl), and the stirrer was turned. The autoclave was then heated to an internal temperature of 30° C. and pressurized with propylene to total pressure of 0.76 MPaG. Subsequently, 0.34 ml of a toluene solution preliminarily prepared, containing 1 mmol of methylaluminoxane in terms of Al and 0.005 mmol of diphenylmethylene (1-ethyl-3-t-butyl-cyclopentadienyl) (2,7-di-t-butyl-fluorenyl) zirconium dichloride (catalyst A), were pressed into the autoclave with nitrogen, and 12 ml of hydrogen was pressed into the autoclave for adjusting molecular weight, then to start polymerization. Thereafter, the autoclave was adjusted to an internal temperature of 30° C. for 60 minutes. After 60 minutes of polymerization, 5 ml of methanol was pressed into the autoclave with nitrogen to stop the polymerization, and the autoclave was depressurized to atmospheric pressure. Acetone was poured into the reaction solution under stirring. The resulting rubbery copolymer (A-1) containing the solvent was dried at 130° C. for 12 hours under reduced pressure.

Production Example 2

Into a fully nitrogen-substituted SUS autoclave with stirring blades having a capacity of 1.5 liters, 750 ml of 4-methyl-1-pentene was charged at 23° C. To this autoclave was charged 0.75 ml of a 1.0 mmol/ml toluene solution of triisobutylaluminum (TIBAl), and the stirrer was turned. The autoclave was then heated to an internal temperature of 30° C. and pressurized with propylene to total pressure of 0.76 MPaG. Subsequently, 0.34 ml of a toluene solution preliminarily prepared, containing 1 mmol of methylaluminoxane in terms of Al and 0.005 mmol of diphenylmethylene (1-ethyl-3-t-butyl-cyclopentadienyl) (2,7-di-t-butyl-fluorenyl) zirconium dichloride (catalyst A), were pressed into the autoclave with nitrogen, and 12 ml of hydrogen was pressed into the autoclave for adjusting molecular weight, then to start polymerization. Thereafter, the autoclave was adjusted to an internal temperature of 30° C. for 60 minutes. After 60 minutes of polymerization, 5 ml of methanol was pressed into the autoclave with nitrogen to stop the polymerization, and the autoclave was depressurized to atmospheric pressure. Acetone was poured into the reaction solution under stirring. The resulting rubbery copolymer (A-2) containing the solvent was dried at 130° C. for 12 hours under reduced pressure.

Production Example 3

Into a fully nitrogen-substituted SUS autoclave with stirring blades having a capacity of 1.5 liters, 750 ml of 4-methyl-1-pentene was charged at 23° C. To this autoclave was charged 1.36 ml of a 0.55 mmol/ml hexane solution of triisobutylaluminum (TIBAl), and the stirrer was turned. Next, the autoclave was heated to an internal temperature of 60° C., 71.0 N mL of hydrogen was added followed by addition of nitrogen until autoclave internal pressure reached 0.40 MPaG, and the autoclave was further pressurized with propylene until the total pressure reached 0.60 MPaG. Subsequently, 1.0 ml of a heptane solution preliminarily prepared, containing 1 mmol of methylaluminoxane in terms of Al and 0.001 mmol of diphenylmethylene (1-ethyl-3-t-butyl-cyclopentadienyl) (2,7-di-t-butyl-fluorenyl) zirconium dichloride (catalyst A), were charged to start polymerization. After 10 minutes of polymerization, 5 ml of methanol was pressed into the autoclave with nitrogen to stop the polymerization, and the autoclave was depressurized to atmospheric pressure. A mixed solution of methanol/acetone was poured into the reaction solution under stirring. The resulting rubbery copolymer (F-1) containing the solvent was dried at 80° C. for 12 hours under reduced pressure.

Production Example 4

500 ml of xylene was placed in a fully nitrogen-substituted glass reactor having an internal volume of 1.0 L and then heated to 90° C., and ethylene and propylene were continuously supplied at 99 liters/h and 36.0 liters/h respectively, while the interior of the polymerization vessel was stirred at 600 rpm, to saturate the liquid phase and the gas phase. Then, in a state in which ethylene and propylene were continuously supplied, 6.0 mL (6.0 mmol) of a toluene solution of triisobutylaluminum (also described as $iBu_3Al$) (1.0 mol/L), 3.0 mL (0.030 mmol) of a toluene solution of the catalyst (B) (0.010 mol/L), and then 12.0 mL (0.120 mmol) of a toluene solution of triphenylcarbenium tetrakis (pentafluorophenyl) borate (also described as $Ph_3CB(C_6F_5)_4$) (0.010 mol/L) were added to perform polymerization under normal pressure at 90° C. for 40 min. The polymerization was stopped by adding a small amount of isobutanol. The obtained polymerization reaction liquid was washed with dilute hydrochloric acid and separated to obtain an organic layer, and the organic layer was introduced into a large amount of methanol to precipitate an ethylene-propylene copolymer. The ethylene-propylene copolymer (F-2) obtained by filtration was dried under reduced pressure at 130° C. for 10 h.

The physical properties of the copolymers obtained in Production Examples from 1 to 4 were measured by the following method.

[Content of Constituent Unit]

The content of constituent unit derived from 4-methyl-1-pentene and constituent unit derived from propylene, in the copolymers were determined by analysis of $^{13}C$-NMR spectra.

In Table 2, C3 refers to a constituent unit derived from propylene and 4MP-1 refers to a constituent unit derived from 4-methyl-1-pentene.

(Measuring Apparatus)

AVANCE III 500 CryoProbe Prodigy type nuclear magnetic resonance apparatus manufactured by Bruker BioSpin (Measurement Conditions)

Measured nucleus: $^{13}C$ (125 MHZ), measurement mode: single-pulse proton broadband decoupling, pulse width: 45° (5.00 μs), number of points: 64 k, measurement range: 250 ppm (−55 to 195 ppm), repetition time: 5.5 s, number of accumulations: 512 times, measurement solvent: orthodichlorobenzene/benzene-$d_6$ (4/1 v/v), sample concentration: ca. 60 mg/0.6 mL, measurement temperature: 120° C., window function: exponential (BF: 1.0 Hz), and chemical shift reference: benzene-$d_6$ (128.0 ppm).

[Glass Transition Temperature (Tg)/Melting Point (Tm)]

The copolymers are subjected to DSC measurements by using a differential scanning calorimeter (X-DSC7000) manufactured by Seiko Instruments Inc., calibrated with an indium standard.

The above measurement sample was weighed on an aluminum DSC pan so as to be approximately 10 mg. A lid was crimped onto the pan to place the sample under a sealed atmosphere, and a sample pan is then obtained.

The sample pan is arranged in a DSC cell and an empty aluminum pan was placed as reference. The DSC cell is heated from −20° C. to 150° C. at 10° C./min under a nitrogen atmosphere (first temperature rise process).

Then, the DSC cell is held at 150° C. for 5 minutes, lowered at 10° C./min, and the DSC cell is cooled down to −100° C. (temperature lowering process). The DSC cell was held −100° C. for 5 minutes and then raised up to a temperature of 150° C. at 10° C./min (second temperature rise process).

A melting peak top temperature of the enthalpy curve obtained in the first temperature rise process was defined as a melting point (Tm), and when two or more melting peaks are present, the highest peak temperature was defined as Tm.

A glass transition temperature (Tg) was defined as an intersection of a straight line obtained immediately before the enthalpy curve obtained in the second temperature rise process, first tilts toward an endothermic side, and the tangent of a straight line tilting immediately thereafter.

[Intrinsic Viscosity [η]]

The intrinsic viscosity [η] of the copolymer was measured at 135° C. by using a decalin solvent. Specifically, approximately 20 mg of copolymer powder, a pellet or a copolymer mass was dissolved in 15 ml of decalin, and a specific viscosity $\eta_{sp}$ was measured in an oil bath at 135° C. To the decalin solution, 5 ml of the decalin solvent was added to dilute the solution, and then the specific viscosity $\eta_{sp}$ was measured in the same manner. This dilution operation was further repeated twice, and a value of $\eta_{sp}/C$ when a concentration (C) was extrapolated to 0, was obtained as the intrinsic viscosity (see the formula below).

$$[\eta]=\lim(\eta_{sp}/C)(C\rightarrow 0)$$

The physical properties of the copolymers are shown in Table 2 and Table 3.

TABLE 2

| Polymerization example | | | Polymerization example 1 | Polymerization example 2 | Polymerization example 3 |
|---|---|---|---|---|---|
| Polymerization conditions | Polymerization temperature | [° C.] | 30 | 30 | 60 |
| | Polymerization time | [min] | 60 | 60 | 10 |
| | Hydrogen | [mL] | 12.0 | 12.0 | — |
| | C3 | [MPa] | 0.76 | 0.76 | 0.20 |
| | 4MP-1 | [mL] | 650 | 750 | 750 |
| | Catalyst (A) | [mmoL] | 0.005 | 0.005 | 0.001 |
| Copolymer | C3 content | [mol %] | 78 | 76 | 30 |
| | 4MP-1 content | [mol %] | 22 | 24 | 70 |
| | Glass transition temperature (Tg) | [° C.] | −5 | −4 | 13 |
| | Intrinsic viscosity [η] | [dl/g] | 1.40 | 1.53 | 0.92 |

TABLE 3

| Polymerization example | | Polymerization example 4 |
|---|---|---|
| C2 content | [mol %] | 55 |
| C3 content | [mol %] | 45 |
| Glass transition temperature (Tg) | [° C.] | — |
| Intrinsic viscosity [η] | [dl/g] | 1.20 |

Example 1

A lubricating oil composition was obtained by using the copolymer (A-1) obtained in Production Example 1 and adjusting the amount compounded so that a kinematic viscosity at 100° C. was approximately 8.0 $mm^2/s$.

The compounding composition of the lubricating oil composition is as follows:

An API group (III) base oil ("Yubase-4" manufactured by SK Lubricants Co., Ltd., kinematic viscosity at 100° C.: 4.21 $mm^2/s$, viscosity index: 123)

Additive*: 8.64% by mass

Pour-point depressant: 0.3% by mass (Polymethacrylate "trade name: Leblanc 165", manufactured by TOHO CHEMICAL INDUSTRY COMPANY, LIMITED)

Copolymers: As shown in Table 4.

In total: 100.0 (% by mass)

Note (*) the additive is a conventional engine oil additive package for GF-5, including overbased detergents of Ca and Na, a N-containing dispersant, aminic and phenolic antioxidants, zinc dialkyl dithiophosphates, a friction modifier, and an antifoaming agent.

The physical properties of the resulting lubricating oil compositions were measured by the following method.

[Kinematic Viscosity]

The kinematic viscosities of the lubricating oil composition at 100° C. (kinematic viscosity at 100° C.) and 40° C. (kinematic viscosity at 40° C.) were measured based on ASTM D446.

[Viscosity Index (VI)]

The viscosity index (VI) was calculated based on ASTM D2270 μsing the results of the kinematic viscosity (KV) at 40° C. and 100° C. of the lubricating oil composition measured based on ASTM D445.

[Cold Cranking Simulator (CCS) Viscosity at −35° C.]

A CCS viscosity (−35° C.) is measured based on ASTM D2602. The CCS viscosity is used for the evaluation of the slidability (startability) of a crankshaft at low temperature. As the value becomes smaller, better low-temperature viscosity (low-temperature characteristics) of the lubricating oil is indicated.

[Solubility in Base Oil]

1 g of copolymer relative to 100 g of base oil was heated at 120° C. under stirring and evaluated by the time the oil took to completely dissolve.

OO: Dissolved within 30 minutes

O: Dissolved in a time range of more than 30 minutes and within 1 hour

Δ: Dissolved in a time range of more than 1 hour and within 3 hours

X: Insoluble or partly undissolved later than 3 hours.

The results are shown in Table 4.

Example 2

A lubricating oil composition was obtained in the same manner as in Example 1, except that the copolymer (A-1) used in Example 1 was replaced with the copolymer (A-2) obtained in Production Example 2. The resulting lubricating oil composition was measured by the method described above.

The results are shown in Table 4.

Comparative Example 1

A lubricating oil composition was obtained in the same manner as in Example 1, except that the copolymer (A-1) used in Example 1 was replaced with the copolymer (F-1) obtained in Production Example 3. The resulting lubricating oil composition was measured by the method described above.

The results are shown in Table 4.

Comparative Example 2

A lubricating oil composition was obtained in the same manner as in Example 1, except that the copolymer (A-1) used in Example 1 was replaced with the copolymer (F-2) obtained in Production Example 4. The resulting lubricating oil composition was measured by the method described above.

The results are shown in Table 4.

TABLE 4

| | Polymerization example | | Example 1 Polymerization example 1 | Example 2 Polymerization example 2 |
|---|---|---|---|---|
| Copolymer | Ethylene content | [mol %] | — | — |
| | Propylene content | [mol %] | 78 | 76 |
| | 4MP-1 content | [mol %] | 22 | 24 |
| | Glass transition temperature (Tg) | [° C.] | −5 | −4 |
| | Melting point (Tm) | [° C.] | none | none |
| | Intrinsic viscosity [η] | [dl/g] | 1.40 | 1.53 |
| Lubricating oil composition | Copolymer amount compounded | [%] | 0.59 | 0.67 |
| | Kinematic viscosity at 100° C. | [$mm^2/s$] | 8.2 | 8.3 |
| | Kinematic viscosity at 40° C. | [$mm^2/s$] | 42.6 | 43.3 |
| | Viscosity index (VI) | [—] | 170 | 171 |
| | CCS at −35° C. | [mPa · s] | 5210 | 5370 |
| | Solubility in base oil | — | ○○ | ○○ |

| | Polymerization example | | Comparative Example 1 Polymerization example 3 | Comparative Example 2 Polymerization example 4 |
|---|---|---|---|---|
| Copolymer | Ethylene content | [mol %] | — | 55 |
| | Propylene content | [mol %] | 30 | 45 |
| | 4MP-1 content | [mol %] | 70 | — |
| | Glass transition temperature (Tg) | [° C.] | 13 | −59 |
| | Melting point (Tm) | [° C.] | none | none |
| | Intrinsic viscosity [η] | [dl/g] | 0.92 | 1.20 |
| Lubricating oil composition | Copolymer amount compounded | [%] | 0.67 | 0.70 |
| | Kinematic viscosity at 100° C. | [$mm^2/s$] | 7.8 | 8.0 |
| | Kinematic viscosity at 40° C. | [$mm^2/s$] | 40.2 | 41.8 |
| | Viscosity index (VI) | [—] | 168 | 165 |
| | CCS at −35° C. | [mPa · s] | 6210 | 6090 |
| | Solubility in base oil | — | ○ | ○ |

The invention claimed is:

1. A lubricating oil composition comprising a copolymer (A) and a base oil (B), wherein the copolymer (A) satisfies the following requirements (a-1) and (a-2), and a content ratio between the copolymer (A) and the base oil (B) is such that the copolymer (A) is in a range of 0.1 to 50 parts by mass per 100 parts by mass in total of the copolymer (A) and the base oil (B):

(a-1) the copolymer (A) is a copolymer of 4-methyl-1-pentene and propylene comprising a constituent unit derived from 4-methyl-1-pentene within a range of 1 mol % or more and 24 mol % or less relative to the total constituent units; and (a-2) an intrinsic viscosity [η] measured in decalin at 135° C. is in a range of 1.3 to 2.0 dl/g.

2. The lubricating oil composition according to claim 1, wherein the copolymer (A) further satisfies the following requirement (a-3):

(a-3) a melting point (Tm) is not detected within a range of −10 to 40° C. in differential scanning calorimetry (DSC).

3. The lubricating oil composition according to claim 1, wherein the copolymer (A) further satisfies the following requirement (a-4):

(a-4) a glass transition temperature (Tg) is in a range of −30 to 20° C. in differential scanning calorimetry (DSC).

4. The lubricating oil composition according to claim 1, wherein the base oil (B) satisfies the following requirement (b-1):

(b-1) a kinematic viscosity at 100° C. is in a range of 1 to 50 $mm^2/s$.

5. The lubricating oil composition according to claim 1, wherein the base oil (B) is a mineral oil of API group (III).

6. The lubricating oil composition according to claim 3, wherein, in the requirement (a-4), the glass transition temperature (Tg) is in a range of −20 to 15° C. in differential scanning calorimetry (DSC).

* * * * *